United States Patent [19]

Yanagida et al.

[11] 3,961,944

[45] June 8, 1976

[54] ALUMINUM-BASE ALLOYS FOR CABLE-SHEATH

[75] Inventors: Kiyomi Yanagida; Tadashi Hirokane; Megumu Sumitomo; Hidenori Takaoka, all of Aichi, Japan

[73] Assignee: Sumitomo Chemical Company, Limited, Osaka, Japan

[22] Filed: May 20, 1974

[21] Appl. No.: 471,745

[30] Foreign Application Priority Data

May 18, 1973 Japan ..... 48-56610
May 18, 1973 Japan ..... 48-56111

[52] U.S. Cl. ..... 75/138; 72/377; 174/102 A; 174/126 CP

[51] Int. Cl.[2] ..... C22C 21/00

[58] Field of Search ..... 75/138, 139; 148/32, 148/32.5; 174/102 A, 126 CP; 72/362, 377

[56] References Cited

UNITED STATES PATENTS

| | | | |
|---|---|---|---|
| 3,219,492 | 11/1965 | Anderson et al. | 75/138 |
| 3,306,787 | 2/1967 | Dies | 148/32 |
| 3,639,107 | 2/1972 | Thompson | 75/138 |

*Primary Examiner*—R. Dean
*Attorney, Agent, or Firm*—Sughrue, Rothwell, Mion, Zinn & Macpeak

[57] ABSTRACT

The cable-sheath material having superior workability and providing an advantage of less eddy current loss to result a power transmission line having high current-carrying capacity is composed of an aluminum-base alloy containing less than about 1.7% by weight Mn and less than about 0.8% by weight Cr in the ranges defined by the following two equations $$3.8 \times \text{Cr-content (wt.\%)} + 3.0 \times \text{Mn-content (wt.\%)} \leqq 5.1$$

$$3.8 \times \text{Cr-content (wt.\%)} + 3.0 \times \text{Mn-content (wt.\&)} \geqq 0.35$$

or an aluminum-base alloy further containing less than about 0.5% by weight Li.

18 Claims, No Drawings

ALUMINUM-BASE ALLOYS FOR CABLE-SHEATH

BACKGROUND OF THE INVENTION

1. FIELD OF THE INVENTION

The present invention relates to a cable-sheath material comprising an aluminum-base alloy having a characteristic of less eddy current loss compared with a conventional aluminum sheath, and superior workability to result a power transmission line having high current-carrying capacity.

2. DESCRIPTION OF THE PRIOR ART

Hitherto, lead, lead alloys, and commercial grade pure aluminum have been used as cable-sheath materials. That is, as well known, lead and lead alloys are excellent in corrosion resistance and workability and provide less eddy current loss due to their low electrical conductivity and hence they have long been used as indispensable cable-sheath materials. However, since lead and lead alloys are inferior in mechanical properties such as tensile stength, creep strength, and fatigue and are large in strain and deformation of the sheath by inside pressure, it is required to increase the thickness of the sheath and increase the offset of the cable during construction. On the other hand, pure aluminum is lower in workability and corrosion resistance as compared with lead and lead alloys and also provides large eddy current loss.

Recently with the increase of the demand for electric power, cables having large current-carrying capacity have been used and for such cable, sheath materials providing particularly lower eddy current loss has been required. For increasing the current-carrying capacity of a transmission cable, it may be considered to increase the cross section of conductor or increase the current density. However, in the case of increasing the cross section of conductor, such troubles occur that already installed sheaths and underground pipes are too small to use for the purpose. Also, in the case of increasing the current density by increasing the electric current with an already installed transmission line having the definite cross section, the eddy current loss and the Joule's heat effect become larger and thus in such cases there is a limitation in the increase of current-carrying capacity. In order to reduce the eddy current loss, it is required to reduce the electrical conductivity of sheath materials as low as possible. That is, since the eddy current becomes lower and the eddy current loss is reduced as the electrical conductivity of sheath materials decreases, thus the current-carrying capacity of a power transmission line shielded such sheath materials can be increased.

A conventional aluminum sheath has an electrical conductivity of 59% IACS (International Annealed Copper Standard) but if, for example, an aluminum alloy having an electrical conductivity of 40% IACS or 35% IACS may be used as a cable-sheath material, the eddy current loss at power transmission is reduced and thus it becomes possible to transmit an electric power of the same capacity as in a cable having a larger size by the already installed cable having a definite cross section (e.g., 1600 $mm^2$).

An object of this invention is, therefore, to provide a cable-sheath material having a conductivity of lower than 55% IACS, preferably lower than 47% IACS, providing less eddy current loss, and having excellent workability required for making a cable sheath, high mechanical strength, proper ductility, and small specific gravity.

Now, the electrical conductivity of aluminum is reduced by the addition of alloying elements but if the content of the alloying elements becomes higher than solid solubility in aluminum, the effect of reducing the conductivity becomes less. The effect of reducing conductivity per unit weight is quite high in Cr, Mn, and Li, and then Ti and Zr follow, and the effect by Cu and Fe is comparatively small.

On the other hand, the workability of aluminum is also reduced by the addition of alloying elements. An aluminum sheath is generally fabricated by an extrusion method and the extrudability is evaluated by the extrusion pressure, extrusion speed, and the presence of defects in the sheath extruded. That is, the extrudability is evaluated to be excellent as the extrusion pressure is lower, the extrusion speed is higher, and the defects in the extruded sheath, such as striking and cracking are less.

As a conventional aluminum sheath, 99.7% aluminum or 99.5% aluminum which does not contain specific elements except impurities such as Fe and Si is used and the 99.7% aluminum is lower in tensile strength and proof stress at a high temperature than 99.5% aluminum but the elongation at a high temperature is same in the both aluminums. In the case of forming a sheath by extruding the cast block of such a metal, the extrusion pressure is lower and the extrusion speed is higher in 99.7% aluminum than in 99.5% aluminum, that is, 99.7% aluminum is quite excellent in workability as compared with 99.5% aluminum. Therefore, in order to reduce the eddy current loss without reducing the workability of the sheath material, it is desired to reduce the electrical conductivity of a sheath material without increasing the high-temperature tensile strength and proof stress and without reducing elongation property.

SUMMARY OF THE INVENTION

As the results of investigating and testing the properties of various aluminum-base alloys as the cable-sheath material, the inventors have discovered that an aluminum-base alloy containing at least one of Mn and Cr, preferably further containing Li provides less eddy current loss than a conventional aluminum sheath and has excellent workability, high mechanical strength, proper ductility, and lower specific gravity than lead and lead alloys, that is, has excellent overall properties as a cable-sheath material.

That is, according to the present invention, there is provided an improved cable-sheath material comprising an aluminum-base alloy containing at least one of less than about 1.7% by weight Mn and less than about 0.8% by weight Cr in the ranges defined by the equation $$0.35 \leqq 3.8 \times \text{Cr-content (wt.\%)} + 3.0 \times \text{Mn-content (wt,\%)} \leqq 5.1$$

or the aluminum-base alloy further containing less than about 0.5% by weight Li, preferably 0.05 to 0.45% by weight Li.

DETAILED DESCRIPTION OF THE INVENTION

Now, the contents of Mn and Cr in the aluminum-base alloy of this invention are limited to the above-defined range by the following reasons. That is, if the contents of Mn and Cr are outside the above-described range when the content of Li is less than about 0.5% by weight, the formation of intermetallic compounds increases to make the conductivity unstable as well as the workability of the alloy is greatly reduced or the conductivity becomes higher than 55% IACS.

The addition effects of Li to the aluminum alloy are as follows:

1. The electrical conductivity is reduced greatly as in Mn and Cr.
2. The workability of the alloy at a high temperature is not reduced or further is increased to some extent contrary to the case of adding Mn and Cr.

Accordingly, by the addition of Li alone, an aluminum-base alloy having a conductivity of lower than 40% IACS is obtained. For example, when 0.75% by weight Li is added to aluminum individually, an aluminum alloy having a conductivity of about 37% IACS and excellent workability is obtained. In spite of such a fact, the content of Li is limited as described above in the present invention since Li is an expensive element as compared with Mn and Cr.

As described above, by alloying Mn and Cr and further Li in aluminum, cable sheaths having various advantages characteristics can be produced. For example, in the case of requiring a cable sheath having a low conductivity without increasing greatly the cost of raw materials, a cable sheath may be produced using an aluminum-base alloy containing at least one of Mn and Cr and containing less amount of or no Li. In this case, if the contents of Mn and Cr are in the range defined by the following equation $$3.8 \times \text{Cr-content (wt.\%)} + 3.0 \times \text{Mn-content (wt.\%)} > 1.2.,$$

the high-temperature tensile strength and the proof stress of the alloy are higher than those of 99.5% aluminum as will be understood from the below-shown examples but the workability is reduced slightly, the reduction to such extent giving no trouble for practical purpose. Therefore, in the case of requiring wide reduction in eddy current loss without increasing greatly the raw material cost at the sacrifice of the workability to slight extent, a cable-sheath material comprising an aluminum-base alloy (having a conductivity of 43.5% – 22% IACS) containing at least one of less than about 1.7% by weight Mn and less than about 0.8% by weight Cr in the range defined by $$1.2 < 3.8 \times \text{Cr-content (wt.\%)} + 3.0 \times \text{Mn-content (wt.\%)} \leqq 5.1$$

may be used. More preferably, a cable-sheath material comprising an aluminum-base alloy (having a conductivity of 40% – 22% IACS) containing at least one of less than about 1.7% by weight Mn and less than about 0.8% by weight Cr in the range defined by $$1.55 \leqq 3.8 \times \text{Cr-content (wt.\%)} + 3.0 \times \text{Mn-content (wt.\%)} \leqq 5.1$$

may be selected.

More preferably, a cable-sheath material comprising an aluminum-base alloy (having a conductivity of 35% – 22% IACS) containing at least one of less than about 1.7% by weight Mn and less than about 0.8% by weight Cr in the range defined by $$2.18 \leqq 3.8 \times \text{Cr-content (wt.\%)} + 3.0 \times \text{Mn-content (wt.\%)} \leqq 5.1$$

is used.

Furthermore, in the case of producing an aluminum sheath by means of a conventional extruding machine, it is required on considering the extrusion capacity thereof to reduce the eddy current loss without reducing the workability of the aluminum alloy. For producing an aluminum cable sheath without increasing greatly the raw material cost in such a case, a cable-sheath material comprising an aluminum-base alloy (having a conductivity of 47% – 43.5% IACS) produced alloying at least one of less than about 1.7% by weight Mn and less than about 0.8% by weight Cr in the range defined by $$0.9 \leqq 3.8 \times \text{Cr-content (wt.\%)} + 3.0 \times \text{Mn-content (wt.\%)} \leqq 1.2$$

in 99.8% or more by weight pure aluminum may be used. In this case, a cable-sheath material having higher workability and less eddy current loss than 99.5% aluminum is obtained.

Then, in the case of requiring the wide reduction in eddy current loss at the sacrifice of raw material cost to some extent, the aluminum-base alloy further containing Li may be used as the cable-sheath material. In this case, as described above the addition of Li does not reduce the workability at a high temperature different from Mn and Cr and thus the aluminum alloy containing Li can give a cable-sheath material having superior workability and lower conductivity or further less eddy current loss than the aluminum base-alloy containing at least one of Mn and Cr.

In addition, between the contents of Mn, Cr, and Li and the conductivity of the aluminum alloy, there is substantially the following relation:

$$\text{Electrical Conductivity (\% IACS)} = 176/[3.8 \times \text{Cr-content (wt.\%)} + 3.0 \times \text{Mn-content (wt.\%)} + 2.85] - 30 \times \text{Li-content (wt.\%)}.$$

Also, slight amounts of impurities contained in aluminum, such as Fe, Cu, V, etc., reduce the hot and cold workability and the corrosion resistance but has an action of reducing the electrical conductivity. The addition of Ti or Zr refines the crystal grains to improve the workability and ductility and at the same time reduces the electrical conductivity. Furthermore, the addition of Sb increases the corrosion resistance of an aluminum alloy.

The aluminum alloy of this invention having the above-described composition is used for producing cable sheaths by any conventional manner employed for producing cable sheaths.

Then, the features of this invention will be explained more clearly by the following examples but the invention is not limited to those examples.

Unless otherwise indicated, all parts, percents, ratios and the like are by weight.

EXAMPLES

Molten aluminum alloys each containing Mn, Cr, and Li as shown in Table 1 were cast in a metallic mold for test piece of JIS Z 2201-4 at 720°C and the electrical conductivity and the tensile properties at room temperature and high temperatures were measured about the casting block thus formed, the result being shown in Table 1. The high temperature tensile properties shown in the table are for evaluating the workability of the alloys. In addition, the relations among the extrusion pressure, the high-temperature tensile strength, and 0.2% proof stress are shown in Table 2.

Table 1

| | Chemical Component (wt.%) | | | | | Conductivity (% IACS) |
|---|---|---|---|---|---|---|
| | No. | Mn | Cr | Li | Al | |
| Examples of this Invention | 1 | 0.32 | — | — | Remain | 46.5 |
| | 2 | 0.41 | — | — | " | 43.0 |
| | 3 | 0.76 | — | 13 | " | 34.5 |
| | 4 | 1.35 | — | — | " | 26.2 |
| | 5 | — | 0.35 | — | " | 42.0 |
| | 6 | — | 0.48 | — | " | 36.3 |
| | 7 | — | 0.56 | — | " | 35.3 |
| | 8 | 0.20 | 0.39 | — | " | 35.6 |
| | 9 | 0.63 | 0.28 | — | " | 30.2 |
| | 10 | 0.33 | 0.66 | — | " | 27.4 |
| | 11 | 0.57 | 0.53 | — | " | 26.9 |

Table 1-continued

| | Chemical Component (wt.%) | | | | | Conductivity (% IACS) |
|---|---|---|---|---|---|---|
| | No. | Mn | Cr | Li | Al | |
| | 12 | 1.06 | 0.34 | — | " | 24.3 |
| | 13 | 0.46 | — | — | " | 41.8 |
| | 14 | — | 0.43 | — | " | 39.1 |
| | 15 | — | 0.32 | — | " | 43.7 |
| | 16 | 0.21 | 0.16 | — | " | 43.1 |
| | 17 | 0.45 | — | 0.08 | " | 38.3 |
| | 18 | 0.46 | — | 0.17 | " | 36.0 |
| | 19 | 0.40 | — | 0.35 | " | 32.3 |
| | 20 | — | 0.40 | 0.08 | " | 36.6 |
| | 21 | — | 0.40 | 0.20 | " | 33.6 |
| | 22 | — | 0.31 | 0.39 | " | 32.3 |
| | 23 | 0.20 | 0.38 | 0.08 | " | 33.6 |
| | 24 | 0.20 | 0.15 | 0.39 | " | 31.5 |
| Conventional Aluminum Sheath | 25 | — | — | — | 99.5 | 59.5 |
| | 26 | — | — | — | 99.7 | 60.6 |

Tensile Properties [at room temperature (20 – 30°C)]

| | No. | Tensile Strength (kg/mm²) | 0.2% Proof Stress (kg/mm²) | Elongation (%) GL 50 mm |
|---|---|---|---|---|
| Examples of this Invention | 1 | 6.9 | 3.5 | 45 |
| | 2 | 7.9 | 3.3 | 41 |
| | 3 | 8.4 | 3.8 | 31 |
| | 4 | 10.7 | 3.9 | 42 |
| | 5 | 6.9 | 3.3 | 39 |
| | 6 | 8.4 | 3.7 | 44 |
| | 7 | 7.4 | 4.2 | 38 |
| | 8 | 7.6 | 4.2 | 35 |
| | 9 | 9.4 | 3.5 | 49 |
| | 10 | 9.8 | 3.9 | 50 |
| | 11 | 9.6 | 4.7 | 31 |
| | 12 | 11.0 | 4.6 | 44 |
| | 13 | 8.3 | 2.9 | 49 |
| | 14 | 8.2 | 3.2 | 47 |
| | 15 | 7.5 | 2.9 | 38 |
| | 16 | 8.0 | 3.0 | 50 |
| | 17 | 7.0 | 2.3 | 44 |
| | 18 | 6.9 | 2.3 | 38 |
| | 19 | 8.4 | 3.0 | 36 |
| | 20 | 6.9 | 2.3 | 46 |
| | 21 | 6.8 | 2.4 | 46 |
| | 22 | 7.9 | 2.9 | 34 |
| | 23 | 7.5 | 4.1 | 38 |
| | 24 | 8.5 | 3.0 | 40 |
| Conventional Aluminum Sheath | 25 | 6.3 | 2.9 | 40 |
| | 26 | 6.9 | 2.4 | 45 |

Tensile Properties (at 450°C)

| | No. | Tensile Strength (kg/mm²) | 0.2% Proof Stress (kg/mm²) | Elongation (%) GL 50 mm |
|---|---|---|---|---|
| Examples of this Invention | 1 | 1.00 | 0.95 | 80 |
| | 2 | 1.32 | 1.26 | 70 |
| | 3 | 1.80 | 1.50 | 31 |
| | 4 | 2.52 | 2.40 | 50 |
| | 5 | 1.38 | 1.33 | 52 |
| | 6 | 1.70 | 1.50 | 48 |
| | 7 | 1.70 | 1.50 | 48 |
| | 8 | 1.70 | 1.50 | 28 |
| | 9 | 2.14 | 2.00 | 59 |
| | 10 | 2.40 | 2.10 | 49 |
| | 11 | 2.45 | 2.00 | 30 |
| | 12 | 2.70 | 2.60 | 50 |
| | 13 | 1.36 | 1.21 | 71 |
| | 14 | 1.48 | 1.34 | 56 |
| | 15 | 1.30 | 1.12 | 70 |
| | 16 | 1.32 | 1.10 | 71 |
| | 17 | 1.32 | 1.18 | 60 |
| | 18 | 1.30 | 1.20 | 65 |
| | 19 | 1.25 | 1.10 | 55 |
| | 20 | 1.47 | 1.33 | 65 |
| | 21 | 1.47 | 1.30 | 60 |

-continued

Tensile Properties (at 450°C)

| | No. | Tensile Strength (kg/mm²) | 0.2% Proof Stress (kg/mm²) | Elongation (%) GL 50 mm |
|---|---|---|---|---|
| | 22 | 1.30 | 1.09 | 48 |
| | 23 | 1.68 | 1.40 | 30 |
| | 24 | 1.30 | 1.09 | 52 |
| Conventional Aluminum Sheath | 25 | 1.18 | 0.98 | 59 |
| | 26 | 0.85 | 0.80 | 60 |

Tensile Properties (at 500°C)

| | No. | Tensile Strength (kg/mm²) | 0.2% Proof Stress (kg/mm²) | Elongation (%) GL 50 mm |
|---|---|---|---|---|
| Examples of this Invention | 1 | 0.72 | 0.70 | 77 |
| | 2 | 0.90 | 0.83 | 72 |
| | 3 | 1.40 | 1.20 | 59 |
| | 4 | 1.92 | 1.88 | 61 |
| | 5 | 1.01 | 1.00 | 60 |
| | 6 | 1.35 | 1.20 | 49 |
| | 7 | 1.40 | 1.20 | 55 |
| | 8 | 1.40 | 1.25 | 72 |
| | 9 | 1.60 | 1.55 | 58 |
| | 10 | 1.85 | 1.68 | 47 |
| | 11 | 2.00 | 1.70 | 42 |
| | 12 | 2.12 | 2.10 | 56 |
| | 13 | 0.96 | 0.90 | 71 |
| | 14 | 1.09 | 1.01 | 54 |
| | 15 | 0.92 | 0.85 | 74 |
| | 16 | 0.91 | 0.80 | 73 |
| | 17 | 0.95 | 0.88 | 74 |
| | 18 | 0.93 | 0.89 | 66 |
| | 19 | 0.80 | 0.71 | 40 |
| | 20 | 1.03 | 1.01 | 65 |
| | 21 | 1.03 | 1.00 | 50 |
| | 22 | 0.91 | 0.81 | 45 |
| | 23 | 1.37 | 1.22 | 61 |
| | 24 | 0.88 | 0.79 | 54 |
| Conventional Aluminum Sheath | 25 | 0.90 | 0.80 | 61 |
| | 26 | 0.65 | 0.63 | 59 |

Table 2

| | | Chemical Component (wt.%) | | | | Tensile Strength (kg/mm²) | | 0.2 Proof Stress (kg/mm²) | | Extrusion Pressure (kg/mm²) | |
|---|---|---|---|---|---|---|---|---|---|---|---|
| | No. | Mn | Cr | Li | Al | 400°C | 500°C | 400°C | 500°C | 400°C | 500°C |
| Conventional Aluminum Sheath | 25 | — | — | — | 99.5 | 1.60 | 0.90 | 1.25 | 0.80 | 18.5 | 11.0 |
| | 26 | — | — | — | 99.7 | 1.20 | 0.65 | 1.10 | 0.63 | 14.6 | 8.3 |
| Examples of this Invention | 17 | 0.45 | — | 0.08 | Remain | 1.83 | 0.95 | 1.59 | 0.88 | 21.5 | 11.8 |
| | 18 | 0.46 | — | 0.17 | " | 1.86 | 0.93 | 1.65 | 0.89 | 22.5 | 12.0 |
| | 20 | — | 0.40 | 0.08 | " | 1.98 | 1.08 | 1.69 | 1.01 | 23.7 | 13.5 |
| | 21 | — | 0.40 | 0.20 | " | 1.98 | 1.08 | 1.71 | 1.00 | 23.4 | 13.7 |
| | 24 | 0.20 | 0.15 | 0.39 | " | 1.80 | 0.88 | 1.44 | 0.79 | 21.0 | 11.2 |
| | 13 | 0.46 | — | — | " | 1.78 | 0.96 | 1.50 | 0.90 | 21.0 | 11.6 |
| | 14 | — | 0.43 | — | " | 1.95 | 1.09 | 1.66 | 1.01 | 23.7 | 13.0 |

Note
Extrusion Conditions:
Extrusion Ratio: 20
Extrusion Speed: 10 mm/min
Extrusion Temperature: 400°C and 500°C As is clear from Table 1, the electrical conductivities of the aluminum alloys of this invention (Examples 1 to 24) were lower than 47% IACS, which was lower than those of 99.5% aluminum (Example 25) and 99.7% aluminum (Example 26) which are conventional cable-sheath materials. Therefore, the eddy current loss in the cable sheaths formed from the aluminum alloys of this invention is less than the conventional aluminum sheaths.

Furthermore, the high-temperature tensile strength and the proof stress of the examples of this invention which are the standard for the evaluation of the hot workability of the materials of this invention are higher than those of 99.5% aluminum (Example 25) which is a conventional cable-sheath material except Examples 1, 2, 19, 22, and 24 of this invention but such strengths give no trouble in regard to the workability of the materials as described above. Moreover, the above properties of Examples 2, 22, and 24 of this invention are same as that of Example 25 at 500°C and those of Examples 1 and 19 are lower than that of Example 25 at 500°C. Furthermore, the elongation of the aluminum alloys of this invention was same as that of the conventional aluminum sheath.

Also, the tensile strength and proof stress of the aluminum alloys of this invention at room temperature are higher than those of the conventional aluminum sheath, that is, the aluminum alloys of this invention are superior clearly in mechanical strength at room temperature to those of conventional cable-sheath materials.

In particular, Example 12 of this invention illustrates the example of reducing greatly the eddy current loss without increasing greatly the raw material cost at the sacrifice of the workability to some extent. That is, the electrical conductivity of the aluminum alloy in Example 12 is 24.3% IACS, remarkably lower than 59.5% IACS of the conductivity of a conventional 99.5% aluminum.

Then, on comparing Example 1 of this invention which reduces the eddy current loss without increasing greatly the raw material cost and without reducing the workability of the aluminum alloy with a conventional cable-sheath aluminum (99.5%) (Example 25), the conductivity of the aluminum alloy of this invention is 46.5% IACS, lower than that of 99.5% aluminum, 59.5% IACS and thus shows less eddy current loss than the latter.

Furthermore, the tensile strength and the proof stress of the aluminum alloy of this invention at high temperature are lower than those of 99.5% aluminum at 450°C and 500°C as shown in the above table.

That is, the tensile strength and the 0.2% proof stress of 99.5% aluminum at 450°C were 1.18 kg/mm² and 0.98 kg/mm², respectively, while the tensile strength and the proof stress of the aluminum alloy of this invention (Example 1) were 1.00 kg/mm² and 0.95 kg/mm² in tensile strength and 0.2% proof stress, respectively at 450°C. And further, the tensile strength and the 0.2% proof stress of 99.5% aluminum at 500°C were 0.90 kg/mm² and 0.80 kg/mm², respectively and the tensile strength and the proof stress of the aluminum alloy of this invention in Example 1 were 0.72 kg/mm² and 0.70 kg/mm² in tensile strength and 0.2% proof stress, respectively at the same temperature. Also, the elongation of the aluminum alloy of this invention in Example 1 is almost same as those of conventional aluminum sheath materials.

Thus, Example 1 of this invention can provide a cable-sheath aluminum alloy having an improved workability without accompanied by great increase of the raw material cost and providing less eddy current loss as compared with a conventional 99.5% aluminum sheath.

Then, on comparing Examples 19, 22, and 24 of this invention which reduced greatly the eddy current loss without reducing the workability of the aluminum alloy at the sacrifice of raw material cost to some extent with a conventional 99.5% aluminum (Example 25), the electrical conductivity of the aluminum alloys of this invention are 31.5–32.3% IACS, largely lower than that of 99.5% aluminum, that is 59.5% IACS and further the eddy current loss in the cable sheath which is made from aluminum alloys of this invention was greatly lower than that of the conventional aluminum cable sheath.

Then, the tensile strength and the 0.2% proof stress of the aluminum alloys of this invention in Examples 19, 22 and 24 at about 500°C were 0.80 to 0.91 kg/mm² and 0.71 to 0.81 kg/mm², respectively, while those of 99.5% aluminum were 0.90 kg/mm² and 0.80 kg/mm², respectively, that is, those values of the aluminum alloys of this invention were almost same as or slightly lower than those of 99.5% aluminum. In other words, in the case of the aluminum alloys of this invention in Examples 19, 22, and 24, the extrusion pressure and the extrusion speed at extrusion thereof were same as those of using 99.5% aluminum or were slightly higher than the latter. Also, the elongation percentage of the aluminum alloys of this invention at high temperatures were 40 to 60% and thus there were no trouble about the occurrence of troubles at extrusion of the alloys.

Furthermore, the tensile strength and the 0.2% proof stress of the aluminum alloys of this invention in Examples 19, 22 and 24 at room temperature were 7.9 to 8.5 kg/mm² and 2.9 to 3.0 kg/mm², respectively, while those of conventional 99.5% aluminum were 6.3 kg/mm² and 2.9 kg/mm², respectively, which show clearly that the aluminum alloys of this invention were improved in those properties. Also, the elongation of the aluminum alloys of this invention at room temperature were 36 to 40% and thus the aluminum alloys of this invention had sufficient ductility as cable-sheath materials.

On comparing the electrical conductivity and the high-temperature strength between Examples 17 and 18 of this invention and Example 13 of this invention; Example 19 of this invention and Example 2 of this invention; Examples 20 and 21 of this invention and Example 14 of this invention; Example 22 of this invention and Example 15 of this invention; Example 23 of this invention and Example 8 of this invention; and Example 24 of this invention and Example 16 of this invention for confirming the effect of the addition of Li as described above, it will be understood that in each case the aluminum alloys of this invention containing Li had lower conductivity and same or slightly lower high-temperature tensile strength and proof stress as compared with the aluminum alloys of this invention without containing Li.

In addition, a cable-sheath material comprising an aluminum alloy of this invention containing 0.25% by weight Mn and 0.45% by weight Li can provide a cable sheath of which the conductivity is about 35.3% IACS, the high-temperature tensile strength and proof stress are same as those of 99.7% aluminum, the eddy current loss is less, and the hot extrudability is almost the same as that of 99.7% aluminum, although this case was not illustrated in the examples.

As described above, the cable-sheath materials of this invention have higher strength at room temperature (20°–30°C) as compared with conventional cable-sheath materials, have sufficient ductility as a cable-sheath material, have excellent workability, and shows less eddy current loss as compared with a conventional aluminum sheath material. Furthermore, the specific gravity of the cable-sheath materials of this invention is lower than lead or lead alloy sheath material, which facilitates the treatment of the sheath materials of this invention. In particular, the present invention can provide a cable-sheath material having workability same as or better than conventional aluminum sheath materials and a cable sheath providing quite less eddy current loss than the conventional aluminum sheath and thus the materials of this invention are particularly suitable as a cable-sheath material of large carrying capacity.

While the invention has been described in detail and with reference to specific embodiments thereof, it will be apparent to one skilled in the art that various changes and modifications can be made therein without departing from the spirit and scope thereof.

What is claimed is:

1. A cable-sheath material comprising an aluminum-base alloy consisting essentially of aluminum and at least one of less than about 1.7% by weight Mn and less than about 0.8% by weight Cr in the ranges defined by the two equations $$3.8 \times \text{Cr-content (wt.\%)} + 3.0 \times \text{Mn-content (wt.\%)} \leqq 5.1$$

$$3.8 \times \text{Cr-content (wt.\%)} + 3.0 \times \text{Mn-content (wt.\%)} \geqq 0.35$$

and 0.05 to 0.45% by weight Li.

2. A cable-sheath material comprising an aluminum-base alloy consisting essentially of aluminum and at least one of less than about 1.7% by weight Mn and less than about 0.8% by weight Cr in the ranges defined by the two equations $$3.8 \times \text{Cr-content (wt.\%)} + 3.0 \times \text{Mn-content (wt.\%)} \leqq 5.1$$

$$3.8 \times \text{Cr-content (wt.\%)} + 3.0 \times \text{Mn-content (wt.\%)} > 1.2$$

and 0.05 to 0.45% by weight Li.

3. A cable-sheath material comprising an aluminum-base alloy consisting essentially of aluminum and at least one of less than about 1.7% by weight Mn and less than about 0.8% by weight Cr in the ranges defined by the two equations $$3.8 \times \text{Cr-content (wt.\%)} + 3.0 \text{ Mn-content (wt.\%)} \leqq 5.1$$

$$3.8 \times \text{Cr-content (wt.\%)} + 3.0 \text{ Mn-content (wt.\%)} \geqq 1.55$$

and 0.05 to 0.45% by weight Li.

4. A cable-sheath material comprising an aluminum-base alloy consisting essentially of aluminum and at least one of less than about 1.7% by weight Mn and less than about 0.8% by weight Cr in the ranges defined by the two equations $$3.8 \times \text{Cr-content (wt.\%)} + 3.0 \times \text{Mn-content (wt.\%)} \leqq 5.1$$

$$3.8 \times \text{Cr-content (wt.\%)} + 3.0 \times \text{Mn-content (wt.\%)} \geqq 2.18$$

and 0.05 to 0.45% by weight Li.

5. A cable-sheath material comprising an aluminum-base alloy consisting essentially of aluminum and at least one of less than about 1.7% by weight Mn and less than about 0.8% by weight Cr in the range defined by the equation $0.35 \leqq 3.8 \times \text{Cr-content (wt.\%)} + 3.0 \times \text{Mn-content (wt.\%)} \leqq 1.2$ and 0.05 to 0.45% by weight Li.

6. A cable-sheath material comprising an aluminum-base alloy consisting essentially of aluminum and at least one of less than about 1.7% by weight Mn and less than about 0.8% by weight Cr in the ranges defined by the two equations $$3.8 \times \text{Cr-content (wt.\%)} + 3.0 \times \text{Mn-content (wt.\%)} \leqq 1.2$$

$$3.8 \times \text{Cr-content (wt.\%)} + 3.0 \times \text{Mn-content (wt.\%)} \geqq 0.9$$

and 0.05 to 0.45% by weight Li.

7. In a method for shielding an electrical power transmission conductor with an aluminum cable-sheath fabricated by an extrusion method, the improvement of providing less eddy current loss and thereby increasing the current-carrying capacity of the power transmission conductor, which comprises using as a cable-sheath material an aluminum-base alloy consisting essentially of aluminum and at least one of less than about 1.7% by weight Mn and less than about 0.8% by weight Cr in the ranges defined by the two equations $$3.8 \times \text{Cr-content (wt\%)} + 3.0 \times \text{Mn-content (wt.\%)} \leqq 5.1$$

$$3.8 \times \text{Cr-content (wt\%)} + 3.0 \times \text{Mn-content (wt.\%)} \geqq 0.35.$$

8. In a method for shielding an electrical power transmission conductor with an aluminum cable-sheath fabricated by an extrusion method, the improvement of providing less eddy current loss and thereby increasing the current-carrying capacity of the power transmission conductor, which comprises using as a cable-sheath material an aluminum-base alloy consisting essentially of aluminum and at least one of less than about 1.7% by weight Mn and less than about 0.8% by weight Cr in the ranges defined by the two equations $$3.8 \times \text{Cr-content (wt.\%)} + 3.0 \times \text{Mn-content (wt.\%)} \leqq 5.1$$

$$3.8 \times \text{Cr-content (wt.\%)} + 3.0 \times \text{Mn-content (wt.\%)} > 1.2.$$

9. In a method for shielding an electrical power transmission conductor with an aluminum cable-sheath fabricated by an extrusion method, the improvement of providing less eddy current loss and thereby increasing the current-carrying capacity of the power transmission conductor, which comprises using as a cable-sheath material an aluminum-base alloy consisting essentially of aluminum and at least one of less than about 1.7% by weight Mn and less than about 0.8% by weight Cr in the ranges defined by the two equations $$3.8 \times \text{Cr-content (wt.\%)} + 3.0 \times \text{Mn-content (wt.\%)} \leqq 5.1$$

$$3.8 \times \text{Cr-content (wt.\%)} + 3.0 \times \text{Mn-content (wt.\%)} \geqq 1.55.$$

10. In a method for shielding an electrical power transmission conductor with an aluminum cable-sheath fabricated by an extrusion method, the improvement of providing less eddy current loss and thereby increasing the current-carrying capacity of the power transmission conductor, which comprises using as a cable-sheath material an aluminum-base alloy consisting essentially of aluminum and at least one of less than about 1.7% by weight Mn and less than about 0.8% by weight Cr in the ranges defined by the two equations $$3.8 \times \text{Cr-content (wt.\%)} + 3.0 \times \text{Mn-content (wt.\%)} \leqq 5.1$$

$$3.8 \times \text{Cr-content (wt.\%)} + 3.0 \times \text{Mn-content (wt.\%)} \geqq 2.18.$$

11. In a method for shielding an electrical power transmission conductor with an aluminum cable-sheath fabricated by an extrusion method, the improvement of providing less eddy current loss and thereby increasing the current-carrying capacity of the power transmission conductor, which comprises using as a cable-sheath material an aluminum-base alloy consisting essentially of aluminum and at least one of less than about 1.7% by weight Mn and less than about 0.8% by weight Cr in the range defined by the equation $0.35 \leqq 3.8 \times \text{Cr-content (wt.\%)} + 3.0 \times \text{Mn-content (wt.\%)} \leqq 1.2$.

12. In a method for shielding an electrical power transmission conductor with an aluminum cable-sheath fabricated by an extrusion method, the improvement of providing less eddy current loss and thereby increasing the current-carrying capacity of the power transmission conductor, which comprises using as a cable-sheath material an aluminum-base alloy consisting essentially of aluminum and at least one of less than about 1.7% by weight Mn and less than about 0.8% by weight Cr in the ranges defined by the two equations $$3.8 \times \text{Cr-content (wt.\%)} + 3.0 \times \text{Mn-content (wt.\%)} \leqq 1.2$$

$$3.8 \times \text{Cr-content (wt.\%)} + 3.0 \times \text{Mn-content (wt.\%)} \geqq 0.9.$$

13. In a method for shielding an electrical power transmission conductor with an aluminum cable-sheath fabricated by an extrusion method, the improvement of providing less eddy current loss and thereby increasing the current-carrying capacity of the power transmission conductor, which comprises using as a cable-sheath material an aluminum-base alloy consisting essentially of aluminum and at least one of less than about 1.7% by weight Mn and less than about 0.8% by weight Cr in the ranges defined by the two equations $$3.8 \times \text{Cr-content (wt.\%)} + 3.0 \times \text{Mn-content (wt.\%)} \leqq 5.1$$

$$3.8 \times \text{Cr-content (wt.\%)} + 3.0 \times \text{Mn-content (wt.\%)} \geqq 0.35$$

and 0.05 to 0.45% by weight Li.

14. In a method for shielding an electrical power transmission conductor with an aluminum cable-sheath fabricated by an extrusion method, the improvement of providing less eddy current loss and thereby increasing the current-carrying capacity of the power transmission conductor, which comprises using as a cable-sheath material an aluminum-base alloy consisting essentially of aluminum and at least one of less than about 1.7% by weight Mn and less than about 0.8% by weight Cr in the ranges defined by the two equations $$3.8 \times \text{Cr-content (wt.\%)} + 3.0 \times \text{Mn-content (wt.\%)} \leqq 5.1$$

$$3.8 \times \text{Cr-content (wt.\%)} + 3.0 \times \text{Mn-content (wt.\%)} > 1.2$$

and 0.05 to 0.45% by weight Li.

15. In a method for shielding an electrical power transmission conductor with an aluminum cable-sheath fabricated by an extrusion method, the improvement of providing less eddy current loss and thereby increasing the current-carrying capacity of the power transmission conductor, which comprises using as a cable-sheath material an aluminum-base alloy consisting essentially of aluminum and at least one of less than about 1.7% by weight Mn and less than about 0.8% by weight Cr in the ranges defined by the two equations $$3.8 \times \text{Cr-content (wt.\%)} + 3.0 \times \text{Mn-content (wt.\%)} \leqq 5.1$$

$$3.8 \times \text{Cr-content (wt.\%)} + 3.0 \times \text{Mn-content (wt.\%)} \geqq 1.55$$

and 0.05 to 0.45% by weight Li.

16. In a method for shielding an electrical power transmission conductor with an aluminum cable-sheath fabricated by an extrusion method, the improvement of providing less eddy current loss and thereby increasing the current-carrying capacity of the power transmission conductor, which comprises using as a cable-sheath material an aluminum-base alloy consisting essentially of aluminum and at least one of less than about 1.7% by weight Mn and less than about 0.8% by weight Cr in the ranges defined by the two equations $$3.8 \times \text{Cr-content (wt.\%)} + 3.0 \times \text{Mn-content (wt.\%)} \leqq 5.1$$

$$3.8 \times \text{Cr-content (wt.\%)} + 3.0 \times \text{Mn-content (wt.\%)} \geqq 2.18$$

and 0.05 to 0.45% by weight Li.

17. In a method for shielding an electrical power transmission conductor with an aluminum cable-sheath fabricated by an extrusion method, the improvement of providing less eddy current loss and thereby increasing the current-carrying capacity of the power transmission conductor, which comprises using as a cable-sheath material an aluminum-base alloy consisting essentially of aluminum and at least one of less than about 1.7% by weight Mn and less than about 0.8% by weight Cr in the range defined by the equation $0.35 \leqq 3.8 \times \text{Cr-content (wt.\%)} + 3.0 \times \text{Mn-content (wt.\%)} \leqq 1.2$ and 0.05 to 0.45% by weight Li.

18. In a method for shielding an electrical power transmission conductor with an aluminum cable-sheath fabricated by an extrusion method, the improvement of providing less eddy current loss and thereby increasing the current-carrying capacity of the power transmission conductor, which comprises using as a cable-sheath material an aluminum-base alloy consisting essentially of aluminum and at least one of less than about 1.7% by weight Mn and less than about 0.8% by weight Cr in the ranges defined by the two equations $$3.8 \times \text{Cr-content (wt.\%)} + 3.0 \times \text{Mn-content (wt.\%)} \leqq 1.2$$

$$3.8 \times \text{Cr-content (wt.\%)} + 3.0 \times \text{Mn-content (wt.\%)} \geqq 0.9$$

and 0.05 to 0.45% by weight Li.

* * * * *